US006000469A

United States Patent [19]

Bassinger

[11] Patent Number: 6,000,469

[45] Date of Patent: Dec. 14, 1999

[54] SELF ALIGNING STUFFING BOX AND GUIDE BUSHING ASSEMBLY

[75] Inventor: Grey Bassinger, Odessa, Tex.

[73] Assignee: Auto Pax Products, L.L.C., Odessa, Tex.

[21] Appl. No.: 09/024,738

[22] Filed: Feb. 17, 1998

[51] Int. Cl.[6] ..... E21B 33/03

[52] U.S. Cl. ..... 166/84.1; 166/241.1; 166/387

[58] Field of Search ..... 166/68, 241.2, 166/81.1, 84.1, 84.4, 176; 251/1.1, 1.2

[56] References Cited

U.S. PATENT DOCUMENTS

| | | | |
|---|---|---|---|
| 2,721,748 | 10/1955 | Tremolada | 286/15 |
| 4,071,085 | 1/1978 | Grable et al. | 166/84.4 |
| 4,289,294 | 9/1981 | McLean | 166/84.4 X |
| 4,889,184 | 12/1989 | Lugtmeier et al. | 166/80 |
| 4,981,174 | 1/1991 | White | 166/84 |
| 5,058,668 | 10/1991 | Newton | 166/84.1 |
| 5,137,083 | 8/1992 | Bump | 166/84 |
| 5,257,812 | 11/1993 | Osorio et al. | 166/84.1 |
| 5,791,411 | 8/1998 | Ricalton et al. | 166/84.1 |
| 5,857,518 | 1/1999 | Vinson, Sr. | 166/81.1 |

*Primary Examiner*—Frank Tsay
*Attorney, Agent, or Firm*—Akin, Gump, Strauss, Hauer & Feld, L.L.P.

[57] ABSTRACT

A stuffing box and guide bushing assembly, particularly adapted for use with a reciprocating pump rod connected to a downhole well pump and to a pumping unit on the Earth's surface. The stuffing box includes a frame comprising a lower plate member with a floor surface, an upper plate member spaced from the lower plate member and including an opposed and generally parallel roof surface, the upper plate member being supported by circumferentially spaced longitudinally extending column members. The upper plate member includes an internal threaded bore centered at the longitudinal central axis of the stuffing box assembly, which axis is also the central axis of the well and the desired central axis of reciprocation of the pump rod. A guide bushing includes a bore for receiving the pump rod and an externally threaded hub portion for engagement with the bore of the upper plate member. The upper plate member is releasably secured to the frame column members by bolts which are arranged on a bolt circle equally spaced so that the upper plate member and the guide bushing may be indexed 90°, 180° or 270° in either direction from an initial position to present a new bearing surface by the bushing with respect to the pump rod as wear occurs on the bushing.

9 Claims, 2 Drawing Sheets

SELF ALIGNING STUFFING BOX AND GUIDE BUSHING ASSEMBLY

FIELD OF THE INVENTION

The present invention pertains to a self aligning stuffing box and guide bushing assembly, particularly adapted for sealing a reciprocating pump rod, such as used in oil well pumping units.

BACKGROUND

U.S. Pat. No. 5,343,944, issued Sep. 6, 1994; U.S. Pat. No. 5,538,080 issued Jul. 23, 1996 and U.S. Pat. No. 5,636,688 issued Jun. 10, 1997, all to Grey Bassinger, disclose and claim self-aligning stuffing boxes for use in sealing the reciprocating pump rod or so-called "polished rod" of well pumping units. The subject matter of these patents is hereby incorporated herein by reference.

Each of the above referenced patents discloses and claims a self-aligning stuffing box assembly which allows a rod packing or seal means to move laterally with respect to the central axis of the stuffing box housing and thereby accommodate some lateral displacement of the pump rod. However, there is still a tendency to wear the packing or seal means generally at the point where the packing or seal holder is being biased in a particular direction with respect to the central axis. Accordingly, the seal means or packing tends to wear unevenly and begin leaking due to the lateral deflection of the rod.

A related problem in assembling the stuffing box and packing assembly or when replacing the polished rod packing, is the difficulty encountered in properly aligning the polished rod with respect to the stuffing box before placing the pumping unit in service. It is often difficult and time-consuming to measure misalignment and adjust the position of the pumping unit with respect to the common central axis of the tubing string, wellhead and stuffing box housing. In this regard it is desirable to provide means which could be used to assist in aligning the polished rod with regard to structure including the stuffing box housing or frame which is already mounted on the wellhead.

The foregoing problems in the art of stuffing boxes for reciprocating pump units have been solved by the present invention.

SUMMARY OF THE INVENTION

The present invention provides a self-aligning stuffing box particularly adapted for sealing reciprocating pump rods, which stuffing box includes a guide bushing for maintaining the pump rod aligned with respect to the stuffing box housing or frame thereby reducing uneven wear on the stuffing box packing.

In accordance with one aspect of the invention a self-aligning stuffing box is provided which includes a frame for supporting a stuffing box packing or seal holder which is adapted to move laterally with respect to the central axis of the frame, which is the desired axis of reciprocation of the polished rod, and including a guide bushing mounted on the frame and serving as a bearing for guiding the polished rod to reduce uneven wear on the packing.

In accordance with another aspect of the present invention there is provided an improved self-aligning stuffing box and guide bushing assembly which is adapted for use in aligning the polished rod of a pumping unit during set-up of the pumping unit at a wellhead or after replacement or repair of the polished rod or part of the wellhead assembly or the stuffing box itself.

In a preferred embodiment of the invention the stuffing box includes a frame comprising spaced apart lower and upper frame plate members interconnected by a plurality of circumferentialy spaced column members. A seal holder is supported between the plate members for limited lateral movement with respect to the central axis of the stuffing box due to lateral excursion of the reciprocating pump rod. A guide bushing is mounted on the upper plate member and includes a cylindrical bore forming a bearing for engagement with the polished rod to aid in aligning the polished rod and to support the polished rod against lateral excursion which could cause significant uneven wear on the stuffing box seal or packing. The guide bushing is preferably threadedly engaged with the upper plate member and includes a head or flange portion which may be engaged by a wrench or other means for ease of connecting and disconnecting the guide bushing with respect to the stuffing box frame.

Those skilled in the art will further appreciate the above-mentioned advantages and features of the invention together with other important aspects thereof upon reading the detailed description which follows in conjunction with the drawing.

DETAILED DESCRIPTION

Figure 1:
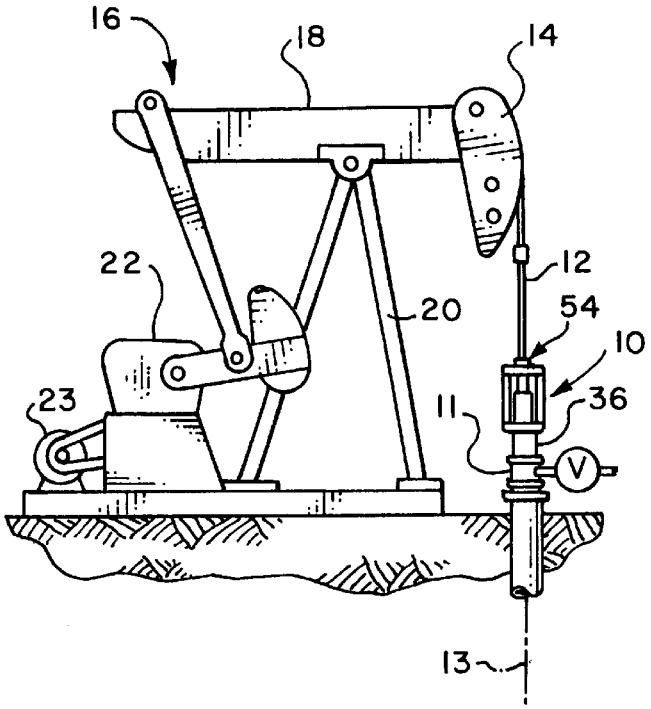
FIG. 1 is a side elevation of a reciprocating rod pumping unit connected to a polished rod of a well pump and showing the stuffing box and guide bushing assembly of the invention mounted on a wellhead.

In the description which follows like parts are marked throughout the specification and drawing with the same reference numerals, respectively. The drawing figures are not necessarily to scale and certain features of the invention may be shown in generalized or somewhat schematic form in the interest of clarity and conciseness.

Referring to FIG. 1, an improved stuffing box and guide bushing assembly 10, in accordance with the invention, is shown mounted on a wellhead 11 of a subterranean well to which has been fitted a reciprocating pump, not shown The aforementioned pump is connected to a reciprocating pump rod or so-called polished rod 12. The polished rod 12 is connected to a so-called horsehead member 14 of a reciprocating pump unit or "pumpjack" 16 including a walking beam 18 supporting the horsehead member 14. The walking beam 18 is mounted for oscillating movement on a frame 20 and is suitably connected to a conventional drive mechanism 22 including a motor 23. The pumpjack 16 is of conventional construction and, forming no part of the present invention, will not be described further herein. However, it is desirable when connecting the pumpjack unit 16 to the polished rod 12, that the polished rod be aligned, as much as possible, with the central longitudinal axis 13 of the wellhead 11 which, typically, is also the central longitudinal axis of the well, the aforementioned subterranean pump and associated tubing structure, all not shown, but known to those skilled in the art.

Figure 3:
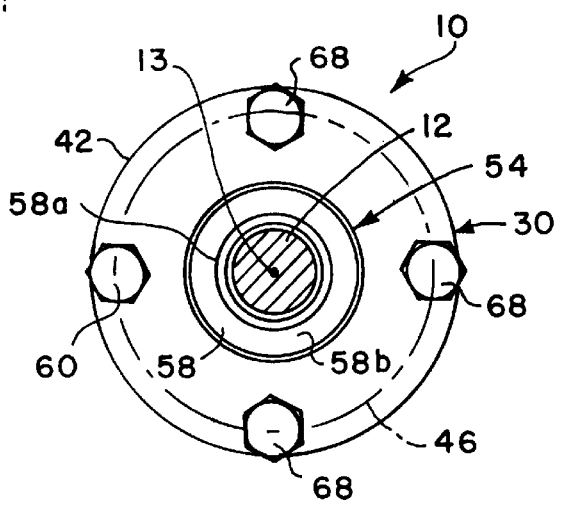
FIG. 3 is a top plan view of the stuffing box and guide bushing assembly.
Figure 4:
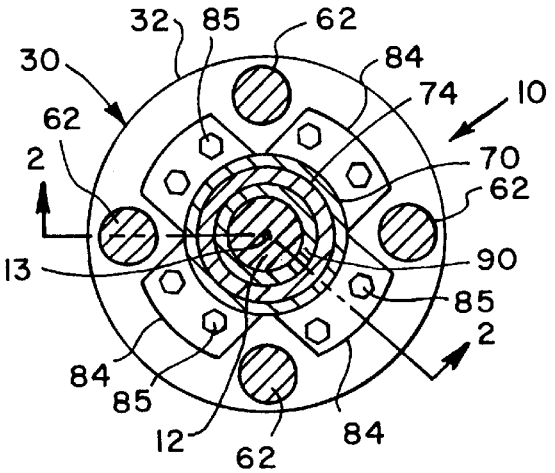
FIG. 4 is a section view taken generally from the line 4—4 of FIG. 2.
Figure 2:
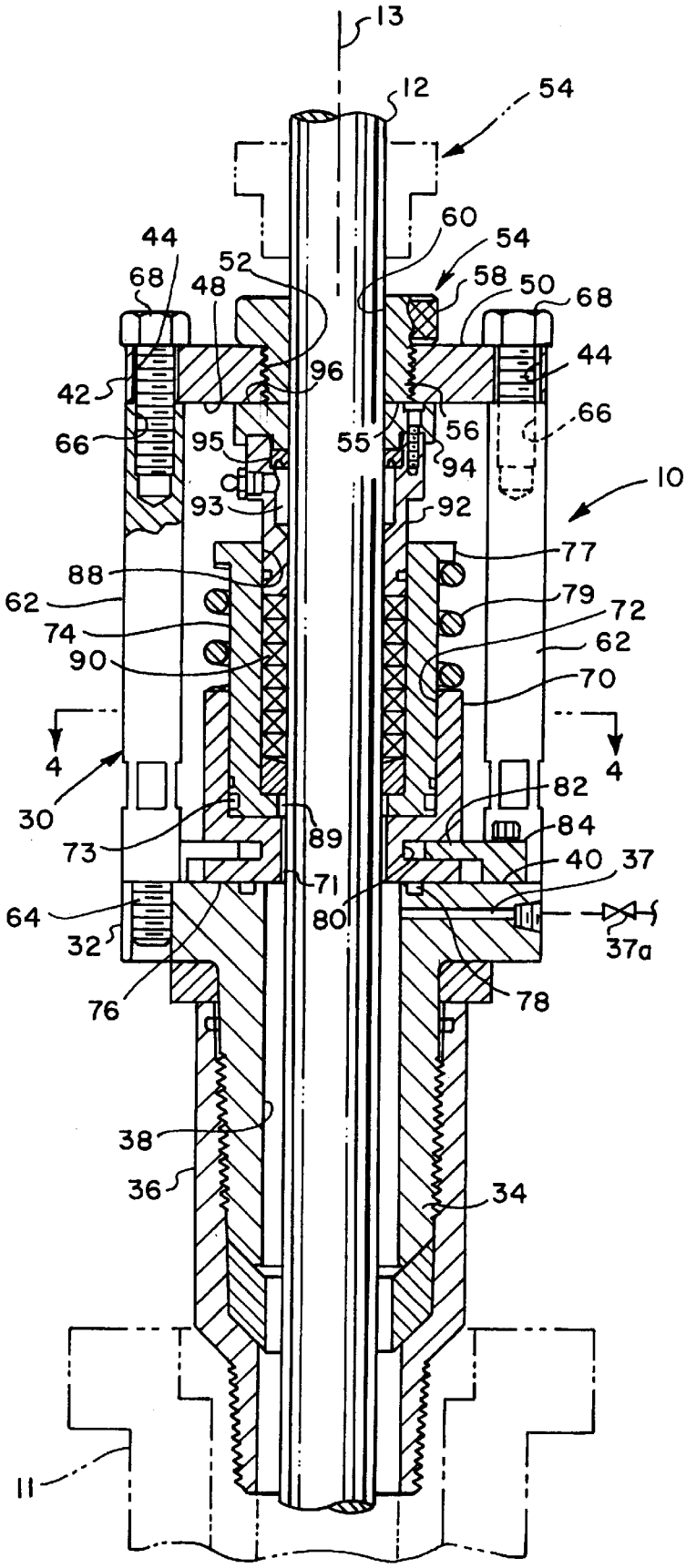
FIG. 2 is a longitudinal central section view of the stuffing box and guide bushing assembly of the present invention taken generally along line 2—2 of FIG. 4.

Referring now to FIGS. 2, 3 and 4 the stuffing box 10 comprises a frame 30 comprising a generally cylindrical lower plate member 32 including a depending threaded spigot portion 34 which is threadedly engaged with a tubular adapter member 36 for connection to a tubing string or other wellhead structure, not shown in detail but understood by those skilled in the art. The plate member 32 includes a longitudinal central bore 38 which opens to a transverse planar floor surface 40 of the lower plate member. The frame 30 also includes an upper, generally cylindrical plate member 42 having four equally spaced apart fastener receiving bores 44, two shown in FIG. 2, which are suitably centered and equally spaced on a bolt circle 46, FIG. 3. The upper plate member 42 includes opposed planar surfaces including a roof surface 48 facing the floor surface 40 and an opposed upward facing surface 50.

The upper plate member 42 also includes a central, longitudinal, internally threaded bore 52, as shown, for receiving a guide bushing member 54 threadedly engaged therewith. The guide bushing 54 includes a reduced diameter externally threaded hub portion 56 engagable with the threaded bore 52 and a head portion comprising a cylindrical knurled flange 58. The guide bushing 54 also includes a central cylindrical bearing bore 60 extending therethrough. The bore 60 is slightly larger in diameter than the diameter of the polished rod 12.

The stuffing box frame 30 further includes four circumferentially spaced generally cylindrical rod-like column members 62 including externally threaded lower distal end portions 64, one shown in FIG. 2 by way of example, threadedly engaged in cooperating bores formed in the lower plate member 32. The column members 62 include, at their opposite ends, internally threaded bores 66, one shown by way of example in FIG. 2, for receiving hexhead machine screws 68, respectively, which project through the bores 44 of the upper plate member 42 for releasably securing the plate member to the column members 62. The bores 64 are spaced 90° apart on the bolt circle 46 also. Accordingly, the upper plate member 42 may be secured to the column members 62 in any one of four positions rotationally indexed 90° from each other.

The stuffing box 10 further comprises a generally cylindrical lower fixture 70 including a cylindrical recess 72 for receiving a cylindrical seal holder 74 axially slidably disposed therein. The lower fixture 70 includes a transverse bottom wall 76 which is slidably engagable with the floor surface 40. A suitable annular seal 78 is disposed in the lower plate member 32 to substantially prevent fluid leakage from the bore 38 past the lower fixture 70. The fixture 70 is also characterized by a circumferential groove 80 operable to receive inwardly projecting finger parts 82 of respective fixture retainers 84, see FIG. 4 also. The retainers 84 are releasably secured to the lower plate member 32 by suitable threaded fasteners 85, as shown in FIG. 4, and are operable to allow limited lateral excursion of the fixture 70 with respect to the axis 13 in any direction about the axis 13.

The seal holder 74 includes an annular bore 88 for receiving a conventional rod packing or seal means 90 to form a fluid tight seal against the circumferential outer surface of the reciprocating rod 12. A cylindrical seal pusher member 92 projects into the bore 88 in forcible engagement with the packing 90. The pusher 92 is suitably secured to a cylindrical upper fixture 94 which includes an upward facing transverse surface 96 engagable with the roof surface 48 and operable to undergo limited sliding movement with respect to the roof surface. A transverse end face 55 of the guide bushing 54 is recessed slightly above the surface 48. As indicated in FIG. 2, the seal pusher 92 includes an annular cavity 93 formed therein for receiving a suitable lubricant to provide a film of lubricant for the rod 12 as it reciprocates with respect to the packing 90, the upper and lower fixtures 94 and 70 and the guide bushing 54. An annular resilient seal member 95 is secured between the pusher 92 and the fixture 94 and is engaged with rod 12 to minimize loss of lubricant upwardly from the cavity 93, viewing FIG. 2.

As shown in FIG. 2, the seal holder 74 includes an upper peripheral transverse flange 77 engagable with a coil spring 79 which is interposed between the fixture 70 and the flange 77 to provide a compression force on the packing or seal means 90.

As further shown in FIG. 2, the lower plate member 32 has a suitable passage 37 formed therein for releasing fluid pressure in the bore 38 when desired. The passage 37 is in communication with a suitable conduit and shutoff valve **37*a* whereby the passage 37 is normally closed during operation of the pumping unit 16 but may be operable to release fluid pressure within the bore 38 when the stuffing box 10** is being serviced or disassembled for any purpose.

In the operation of the stuffing box 10, when the stuffing box has been assembled to a wellhead, such as the wellhead 11, with a reciprocating pump rod 12 extending through the bore 38, the seal holder 74 and the upper plate member 42, the guide bushing 54 may be slipped over the top end of the pump rod 12 and used as a guide for aligning the pumping unit 16 so that the rod pump rod 12 is not biased laterally in a direction displaced from the central axis 13. This activity may be carried out after the pump rod 12 is connected to the horsehead member 14. Accordingly, with the guide bushing 54 loosely slidably disposed on the pump rod 12 it may be used as a guide for centering the pump rod with respect to the bore 52, for example.

Once the guide bushing 54 has been used to center the pump rod 12 as much as practically possible, the guide bushing is threadedly engaged with the bore 52 and suitably tightened against the upper surface 50 of the upper plate member 42.

The pumping unit 16 may then be placed in operation to reciprocate the pump rod 12 while the stuffing box assembly 10 serves as a suitable seal to prevent loss of pressure fluid from the bore 38, through the bore 71 of the lower fixture 70 and the reduced diameter bore 89 of the seal holder. Fluid pressure acting on the lower distal end of the packing 90, together with the bias force of the coil spring 79, will maintain the packing compressed fluid tight against the rod 12. Pressure fluid is also prevented from escaping from the fixture 70 or the seal holder 74 thanks to seals 78 and 73, as shown.

Even though the pump rod 12 is substantially centered prior to placing the pumping unit 16 in service, some lateral displacement of the pump rod from the central axis 13 may be urged by misalignment conditions or other forces acting on the pump rod. However, the guide bushing 54 will react lateral bearing forces on the bushing to maintain the pump rod substantially centered and to reduce wear on the packing 90. The guide bushing 54 is preferably made of a suitable bearing material such as naval brass which will undergo some wear as bearing forces are exerted thereon by the pump rod 12 being biased laterally from the axis 13. As wear of the guide bushing 54 occurs and the guide bushing begins to lose its centering effect on the pump rod 12 the pumping unit 16 may be momentarily shut down, the bolts 68 removed and the upper plate member 42 indexed 90°, 180° or 270°, as desired. After indexing the upper plate member 42 rotationally about the axis 13, the bolts 68 are reassembled to the column members 62 and tightened to retain the upper plate member in its working position along with the guide bushing 54.

The guide bushing 54 may enjoy a long service life when the lateral forces acting on the pump rod 12 remain in a substantially constant direction. By way of example, a guide bushing for use with a polished rod having a nominal diameter of 1.50 inches would have a diameter of its hub portion 56 of about 2.25 inches and a diameter of its flange portion 58 of about 3.13 inches. The bore 60 would have a diametral clearance of from about 0.006 inches to 0.008 inches. Approximately 0.38 inches of lateral wear could be incurred by the bushing 54 before it required indexing. As shown in FIG. 3, a wear gauge in the form of a circumferential groove 58*a* may be formed in the upward facing transverse 58*b* surface of the flange 58.

Accordingly, it will be appreciated from the foregoing description that the stuffing box and guide bushing assembly 10 is particularly advantageous in that, by providing the guide bushing 54 supported on the stuffing box frame 30 in the manner described and shown, the assembly of the lower fixture 70, the seal holder 74, the packing 90, the seal pusher 92 and the upper fixture 94 may "track" and follow the wear imposed on the guide bushing 54 by the rod 12 in any heading about the axis 13 while negligible uneven wear is imposed on the packing 90. With the component dimensions mentioned above, for example, lateral forces acting on the pump rod 12 can cause wear on the guide bushing 54 in a particular radial direction with respect to the axis 13 up to about 0.38 inches without causing essentially any uneven wear on the packing 90.

The construction and operation of the stuffing box and guide bushing assembly 10 described hereinabove is believed to be within the purview of one of ordinary skill in the art based on the foregoing description. Conventional engineering materials known to those skilled in the art and including those materials and components described in the patents incorporated herein by reference may be used in the construction and operation of the stuffing box 10.

Although a preferred embodiment of the invention has been described in detail herein, those skilled in the art will also recognize that various modifications and substitutions may be made without departing from the scope and spirit of the appended claims.

What is claimed is:

1. A self aligning stuffing box and guide bushing assembly comprising:

a frame including a floor surface and a roof surface spaced from, opposed to and generally parallel with said floor surface;

a seal holder including a packing disposed therein and forming a seal around a reciprocating pump rod extending through said frame, said seal holder being supported by said frame for limited lateral excursion with respect to a central longitudinal axis; and a guide bushing supported by said frame and having a bore forming a bearing surface for engagement with said pump rod to react lateral forces acting on said pump rod whereby said seal holder and said packing may follow wear on said guide bushing in any direction about said central longitudinal axis while experiencing negligible uneven wear on said packing.

2. The stuffing box set forth in claim 1 wherein:

said frame includes a support member for supporting said guide bushing, said support member being releasably secured to another part of said frame in a selected one of plural positions whereby said guide bushing may be rotatably indexed about said central axis to present an unworn bearing surface to react bearing forces imposed thereon by said pump rod.

3. The stuffing box set forth in claim 2 wherein:

said frame includes a lower plate member including said floor surface, and an upper plate member comprising said support member and including said roof surface, and a plurality of circumferentially spaced apart column members extending between said lower plate member and said upper plate member, said upper plate member being releasably secured to said column members with mechanical fasteners.

4. The stuffing box set forth in claim 3 wherein:

said upper plate member includes a threaded bore centrally disposed on said frame and having an axis substantially coincident with said central axis and said guide bushing includes a threaded hub portion engagable with said threaded bore for releasably securing said guide bushing to said upper plate member.

5. The stuffing box set forth in claim 4 wherein:

said guide bushing includes an enlarged diameter flange part integral with said hub portion and engagable with a surface on said plate member to releasably secure said guide bushing to said frame.

6. A stuffing box for a reciprocating cylindrical pump rod comprising:

a frame including a part adapted to be mounted on a wellhead, said frame including a support for a seal holder and for allowing lateral excursion of said seal holder with respect to a central longitudinal axis which defines a desired axis of reciprocation of said pump rod;

said seal holder including packing means engagable with said pump rod to form a substantially fluid tight seal to prevent leakage of pressure fluid from said wellhead;

a guide bushing mounted on said frame and including a central bore forming a bearing surface engagable with said pump rod and operable to react bearing forces from said pump rod attempting to displace said pump rod laterally with respect to said central longitudinal axis; and a member for supporting said guide bushing in selected rotational positions about said central longitudinal axis.

7. The stuffing box set forth in claim 6 wherein:

said member for supporting said guide bushing comprises a plate member mounted on said frame and secured to said frame by mechanical fastener means at selected rotational positions about said central longitudinal axis.

8. The stuffing box set forth in claim 7 wherein:

said plate member includes a threaded bore formed therein and said guide bushing includes a threaded hub portion for releasable threaded engagement with said threaded bore.

9. A method for aligning a reciprocating pump rod with respect to a central axis of a well in which said pump rod is extending, said well having a well structure including means for supporting a stuffing box, said method comprising the steps of:

providing a stuffing box supported on said well structure and comprising a frame, a seal holder including a packing disposed therein and forming a seal around a reciprocating pump rod extending through said frame, said seal holder being supported by said frame for limited lateral excursion with respect to said central longitudinal axis, and a guide bushing releasably supported by said frame and having a bore forming a bearing surface for engagement with said pump rod to react lateral forces acting on said pump rod tending to displace said pump rod laterally away from said central axis;

placing said guide bushing on said pump rod and moving said guide bushing toward a position for connection to said stuffing box while using said guide bushing as an alignment device for aligning said pump rod with respect to said stuffing box and said central axis; and connecting said guide bushing to said stuffing box for reacting bearing loads imposed thereon by said pump rod due to lateral forces tending to displace said pump rod laterally from said central axis.

* * * * *